US007544085B2

(12) United States Patent
Baldwin et al.

(10) Patent No.: US 7,544,085 B2
(45) Date of Patent: Jun. 9, 2009

(54) STRAIN RELIEF BACKSHELL ASSEMBLY

(75) Inventors: Brendon A. Baldwin, Guilford, NY (US); David O. Gallusser, Oneonta, NY (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 11/976,359

(22) Filed: Oct. 24, 2007

(65) Prior Publication Data

US 2009/0111321 A1 Apr. 30, 2009

(51) Int. Cl.
*H01R 13/58* (2006.01)

(52) U.S. Cl. ..... 439/471; 439/610; 439/446; 439/472

(58) Field of Classification Search ..... 439/471, 439/446, 472, 610
See application file for complete search history.

(56) References Cited

U.S. PATENT DOCUMENTS 3,603,913 A 9/1971 Hasty, Jr.
3,732,527 A 5/1973 McKnight
3,781,762 A * 12/1973 Quackenbush ..... 439/322
4,135,776 A * 1/1979 Ailawadhi et al. ..... 439/583
4,564,255 A 1/1986 Kirma
4,761,146 A * 8/1988 Sohoel ..... 439/584
6,419,519 B1 7/2002 Young

FOREIGN PATENT DOCUMENTS

DE 3135781 3/1983

* cited by examiner

*Primary Examiner*—Tho D Ta
*Assistant Examiner*—Travis Chambers
(74) *Attorney, Agent, or Firm*—Blank Rome LLP

(57) ABSTRACT

A backshell assembly that includes a housing configured to terminate a cable that has a main body defining a central longitudinal axis and a connector interface for mating with an electrical connector. At least one adjustment extension extends from the main body opposite the connector interface and substantially parallel to the central longitudinal axis. An adjustable strain relief structure is coupleable to the cable and the housing. The adjustable strain relief structure includes at least one adjustment member coupleable to the cable that cooperates with the adjustment extension of the housing such that the adjustment member is moveable between different cable positions with respect to the central longitudinal axis of the housing. A biasing member is disposed between the at least one adjustment member and the at least one adjustment extension of the main body. The biasing member biases the at least one adjustment member into engagement with the at least one adjustment extension.

19 Claims, 8 Drawing Sheets

STRAIN RELIEF BACKSHELL ASSEMBLY

FIELD OF THE INVENTION

The present invention relates to a strain relief backshell assembly that terminates a cable for mating with an electrical connector. The strain relief backshell assembly is adjustable to different configurations of the cable with respect to the electrical connector.

BACKGROUND OF THE INVENTION

Backshell assemblies provide a transition between a cable and an electrical connector. Strain relief backshell assemblies in particular provide a clamping force on the wire bundle of the cable to prevent damage to the termination of the wires at the electrical connector. Various configurations of the backshell assemblies are known. For example, 0°, 45° and 90° configurations of backshell assemblies are known in which the configurations are defined by the angle between the cable and the backshell assembly. Conventional backshells are typically available in both EMI and Non-EMI versions. EMI backshells provide termination of cable shielding braid through a series of components to complete a conductive path from individual wire shielding to the electrical connector. The conductive interface between the backshell assembly and the electrical connector is typically the accessory locating teeth.

The various configurations of conventional backshell assemblies are often separately manufactured. That requires separate tooling for each configuration, thereby increasing costs of the assemblies. Also, unless a user can accurately predict the number and types of configurations of the backshell assemblies needed, any field changes would require the user to purchase additional backshell assemblies.

SUMMARY OF THE INVENTION

Accordingly, the present invention relates to a backshell assembly that includes a housing configured to terminate a cable that has a main body defining a central longitudinal axis and a connector interface for mating with an electrical connector. At least one adjustment extension extends from the main body opposite the connector interface and substantially parallel to the central longitudinal axis. An adjustable strain relief structure is coupleable to the cable and the housing. The adjustable strain relief structure includes at least one adjustment member coupleable to the cable that cooperates with the adjustment extension of the housing such that the adjustment member is moveable between different cable positions with respect to the central longitudinal axis of the housing. A biasing member is disposed between the at least one adjustment member and the at least one adjustment extension of the main body. The biasing member biases the at least one adjustment member into engagement with the at least one adjustment extension. The biasing member allows adjustment of the at least one adjustment member between the different cable positions with respect to the at least one adjustment extension of the housing without disassembly of the housing and the adjustable strain relief structure.

The present invention also relates to a method of adjusting a backshell assembly for a cable including the steps of terminating an end of the cable with the housing of the backshell assembly; and coupling the adjustable strain relief structure with the housing by releasably engaging a first arm of the strain relief structure with the housing to configure the cable in at least a first position with respect to the housing, and pivotally connecting a second arm of the strain relief structure with the housing allowing rotation of the adjustable strain relief structure and the cable with respect to the housing. The method also includes the steps of disengaging the first arm from the housing by slidably moving the first arm of the strain relief structure with respect to the second arm against the bias of a biasing member supported by the second arm; and releasably locking the first arm in a second position different from the first position by releasing the first arm of the strain relief structure so that the first arm slides with respect to the second arm into engagement with the housing.

The present invention also relates to a backshell assembly for mating with an electrical connector that has a housing configured to terminate a cable. The housing has a main body defining an inner bore and a central longitudinal axis. The housing receives the cable in the inner bore along the central longitudinal axis. The main body includes a connector interface for mating with an electrical connector. The cable has a shielding braid with a terminal end that is folded over the connector interface of the housing allowing direct contact with a connector shell of the electrical connector.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Referring to FIGS. 1-6, the present invention relates to a strain relief backshell assembly 100 for coupling an electrical connector 600 (FIG. 6) with EMI braid shield S covering a cable C. The backshell assembly 100 allows adjustment of the position of the cable C with respect to the connector without having to disassemble the components of the backshell assembly 100. The backshell assembly 100 is also configured to provide improved EMI protection.

Figure 3A:
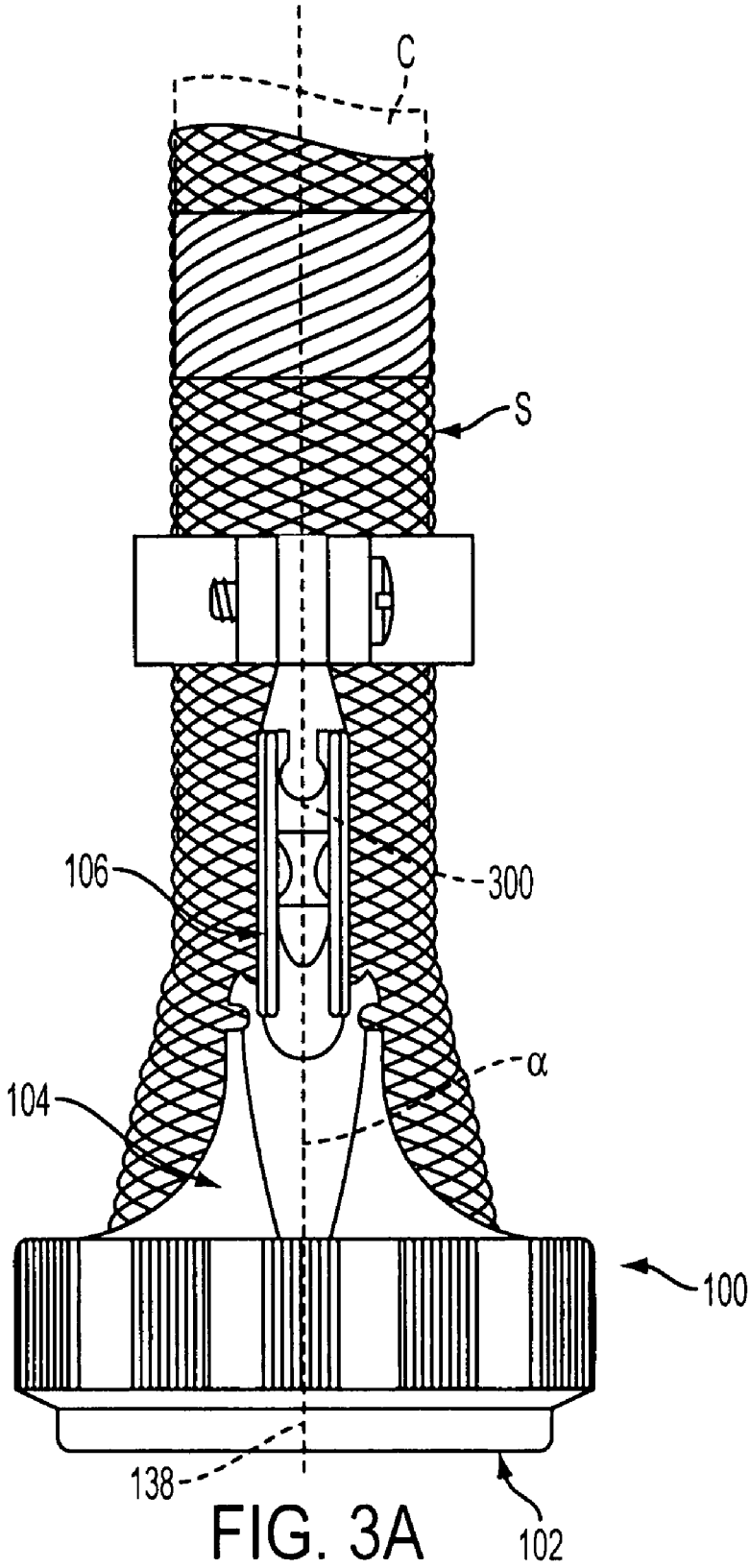
FIGS. 3A-3C are side elevation views of the backshell assembly illustrated in FIG. 2, showing the backshell assembly, in each of the three different configurations with respect to cable.
Figure 3B:
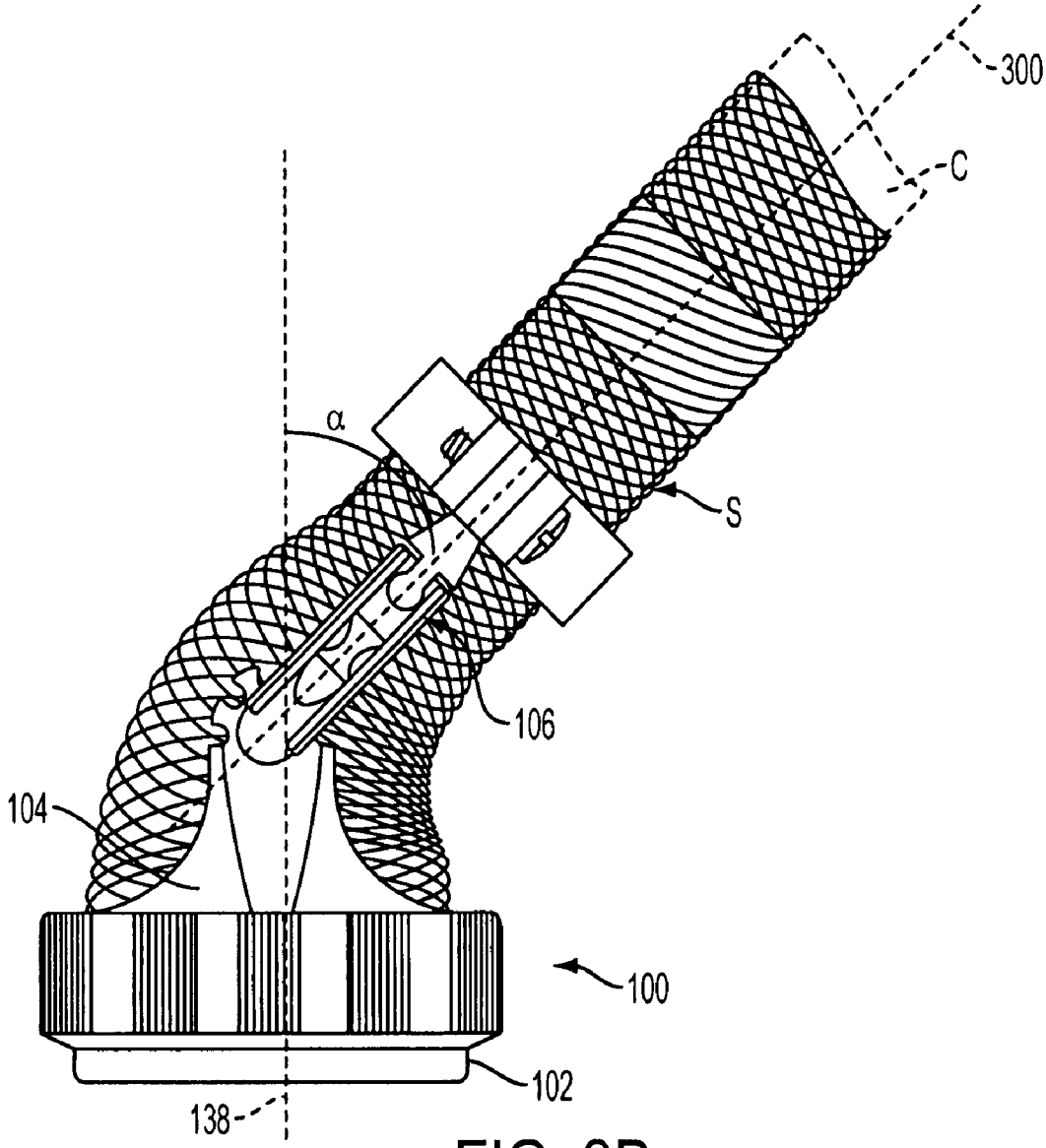
Figure 3C:
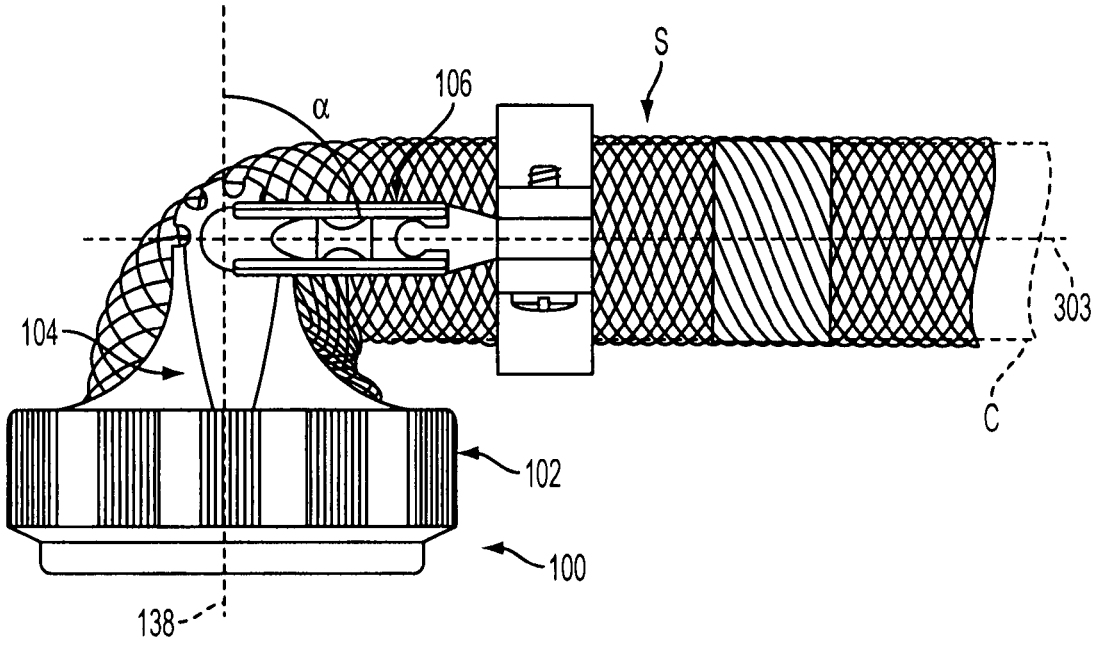

In general the strain relief backshell assembly 100 includes a coupling nut 102 that interfaces with the electrical connector; a backshell housing 104 that receives and terminates the shielding braid of cable C and mates with the coupling nut 102; and an adjustable strain relief structure 106 that clamps to the cable C, couples to the backshell housing 104, and allows adjustment of the position of the cable C with respect to the backshell housing 104. The adjustable strain relief structure 106 allows in field adjustment of the cable configuration with respect to the electrical connector without disassembling the housing 104 and the strain relief structure 106. The in field adjustment also eliminates the need for separate backshell assemblies corresponding to different configurations of the cable. FIGS. 3A, 3B, and 3C illustrate three exemplar configures of the cable C, i.e. 0°, 45° and 90° configurations.

Figure 1:
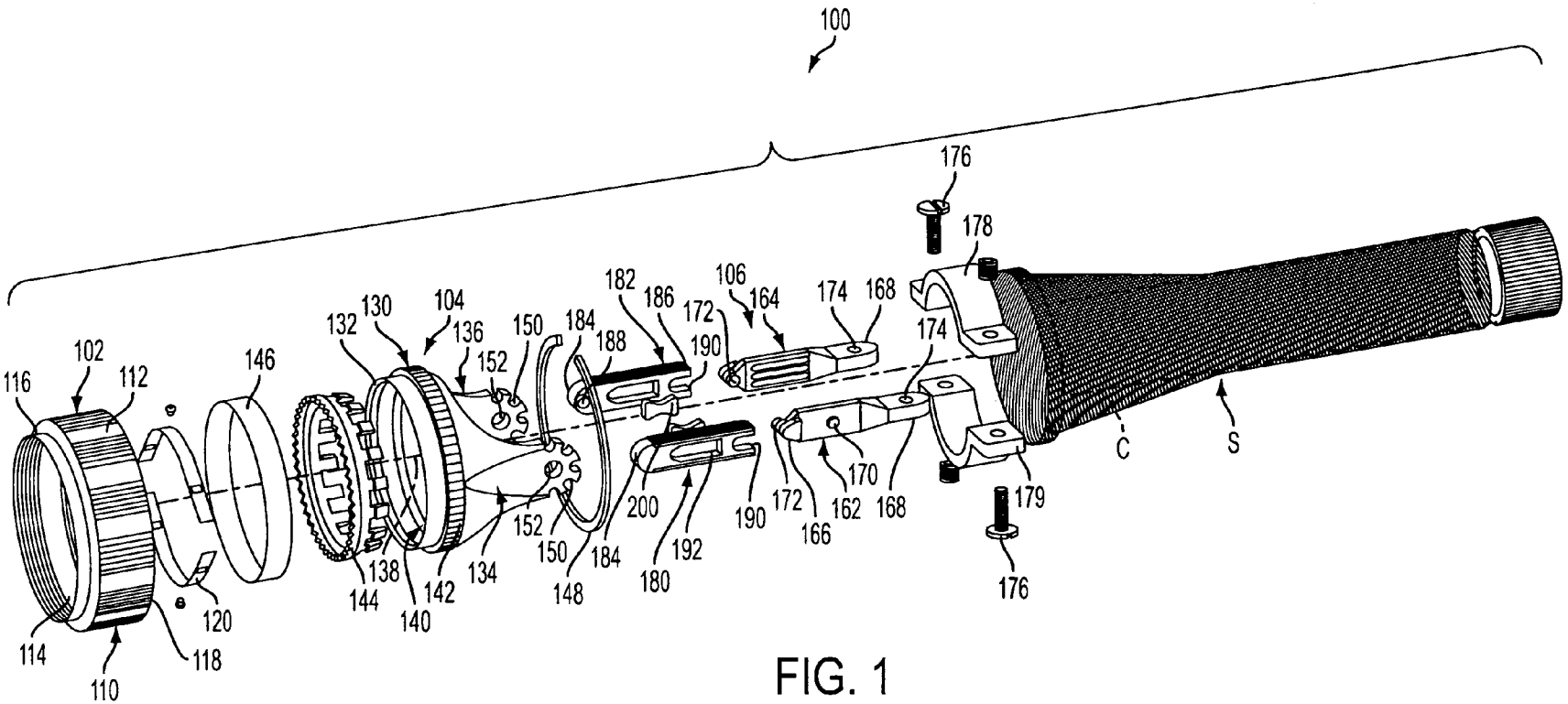
FIG. 1 is an exploded perspective view of a backshell assembly according to an exemplary embodiment of the invention.
Figure 2:
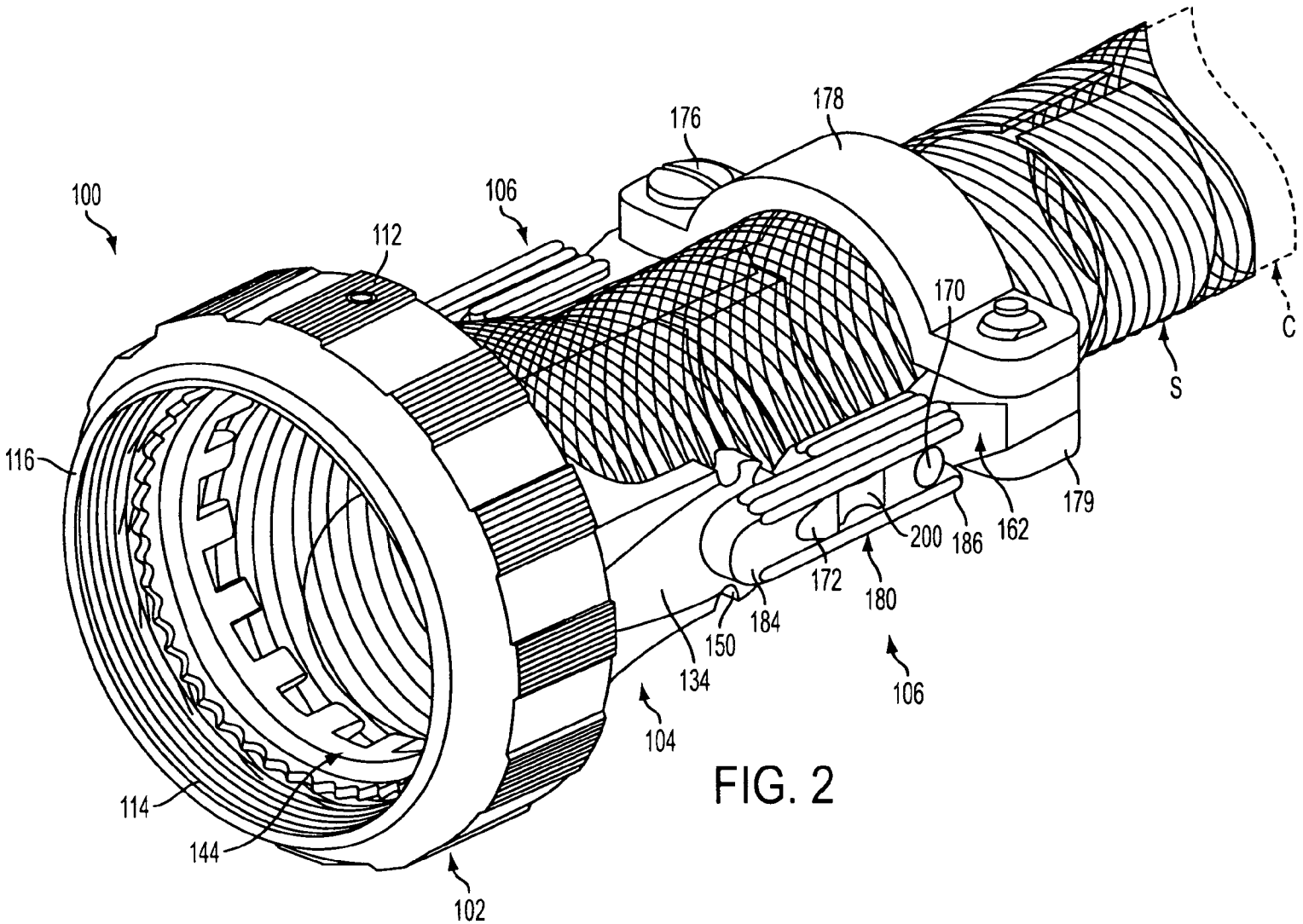
FIG. 2 is an enlarged perspective view of the backshell assembly illustrated in FIG. 1, showing the backshell assembly in an assembled configuration ready for terminating a cable.

As seen in FIGS. 1 and 2, the coupling nut 102 may include a ring body 110 with an outer gripping surface 112 and internal threads 114. An opening face 116 of the coupling nut 102 receives the electrical connector and threads thereon via its internal threads 114. The face 118 opposite the opening face 116 mates with the backshell housing 104. The coupling nut 102 may also accept anti-vibration springs 120 as is well known in the art.

The backshell housing 104 may include a main ring-shaped body 130 having a connector interface 132 at one end and adjustment extensions 134 and 136 at the other end. The main body 130 defines a central longitudinal axis 138 and an inner bore 140 that receives the cable C along the central longitudinal axis 138. A ring of gear teeth 142 may extend outwardly from the main body 130 which function to reduce vibration. The housing 104 may also accept an accessory locating ring 144 and a termination ring 146.

Figure 6:
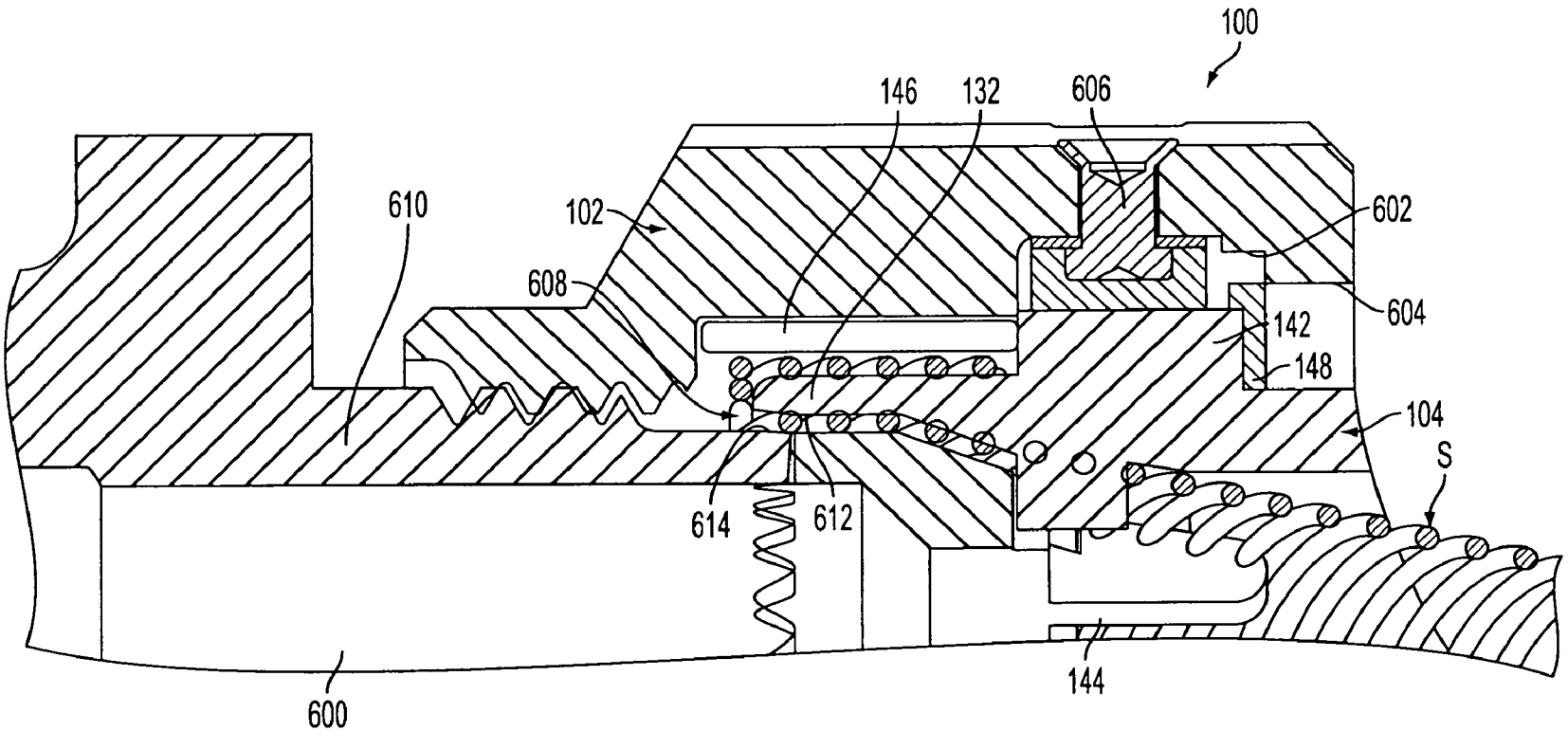
FIG. 6 is an enlarged partial side view in section of the backshell assembly connected to an electrical connector, showing the method for shielding braid termination whereas the shielding braid makes direct contact with the rear outside diameter of an electrical connector.

As seen in FIGS. 2 and 6, the connector interface 132 is received in the open end 116 of the coupling nut 102 for connection to the electrical connector 600. A retaining ring 148 positioned behind the ring of gear teeth 142 retains the housing 104 in the coupling nut 102.

Figure 4:
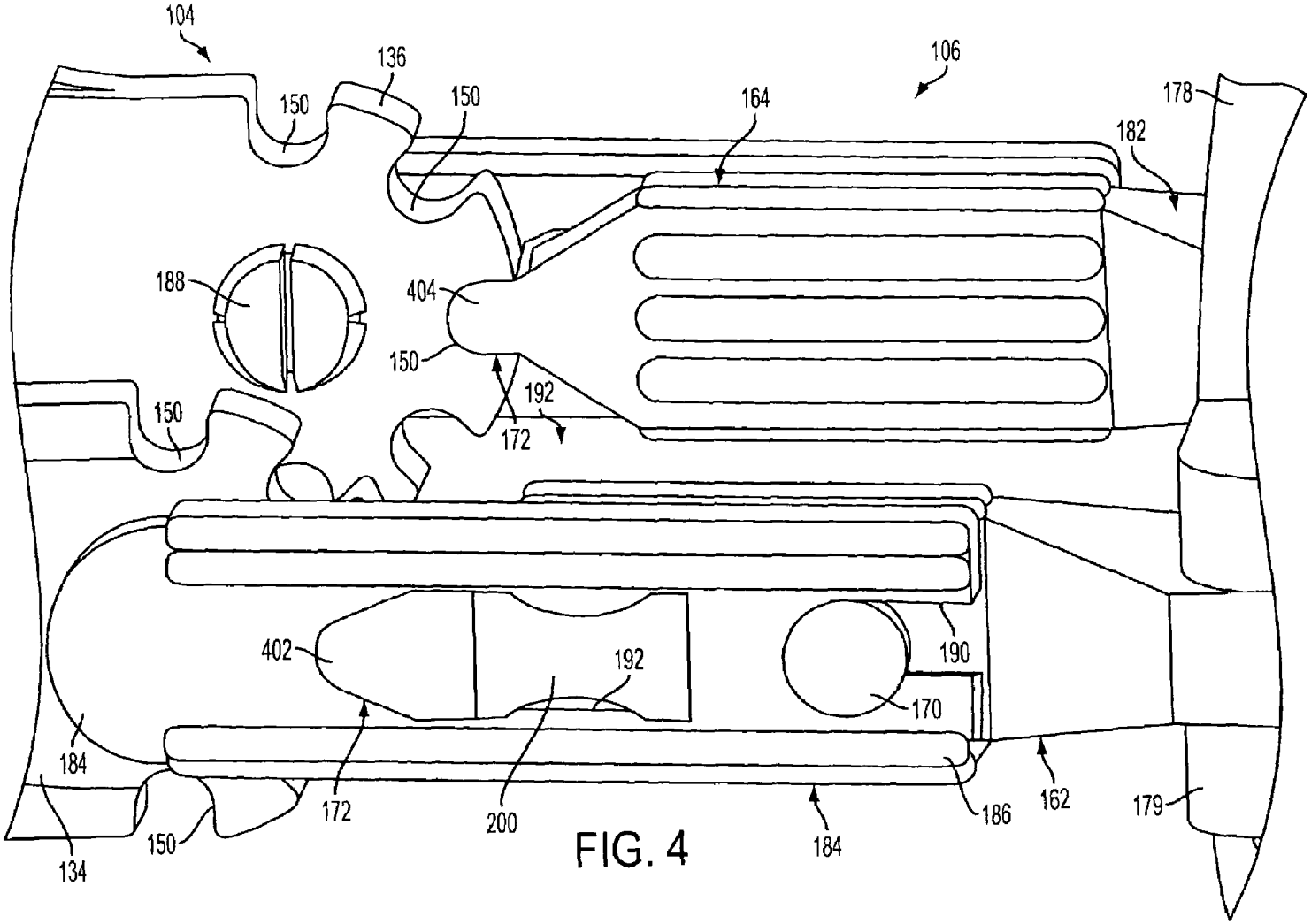
FIG. 4 is an enlarged partial side perspective view of the backshell assembly illustrated in FIG. 2, showing a strain relief structure of the backshell assembly engaged with a housing of the backshell assembly.

The adjustment extensions 134 and 136 of the housing 104 extend generally parallel to the central longitudinal axis 138 along the outside of the EMI braid shield S and are configured to couple with the strain relief structure 106. Each extension 134 and 136 is substantially flat with a distal end that includes a plurality of radial notches 150 (FIGS. 1 and 4). Central to the radial notches 150 is a pivot hole 152 that allows rotation of the strain relief structure 106 and the cable C with respect to the housing 104.

As best seen in FIG. 1, the adjustable strain relief structure 106 may have an adjustment member 160 that preferably includes a pair of first strain relief arms 162 and 164. Although the pair of arms 162 and 164 is preferred, the adjustment member may include only a single strain relief arm, or it may include other structures, such as a ring body.

Each first strain relief arm 162 and 164 may include opposite first and second ends 166 and 168. Between the first and second ends 166 and 168 of each arm is a locating pin 170. Each first end 166 includes a position pin 172 extending therefrom toward the opposite arm and each second end 168 includes a fastening hole 174. The fastening holes 174 receive fasteners 176, such as screws, for coupling the first strain relief arms 162 and 164 to respective cable clamps 178 and 179. The cable clamps 178 and 179 may be clamped to the cable C, as is well known in the art.

The adjustable strain relief structure 106 may also include a pair of second strain relief arms 180 and 182. Each second strain relief arm 180 and 182 includes opposite first and second ends 184 and 186. Each first end 184 includes a pivot pin extension 188 (FIGS. 4 and 5) extending towards the opposite arm that engages the respective pivot holes 152 of the backshell housing extensions 134 and 136. That allows the strain relief structure 106 to rotate with respect to the backshell housing 104. Each second end of the strain relief arms 180 and 182 includes a cut-out 190 sized to receive the location pin 170 of a respective first strain relief arm 162 and 164. Between the first and second ends 184 and 186 of each second strain relief arm 180 and 182 is a slot 192 that receives a portion of the position pin 172 of a respective first arm 162 and 164. Each first strain relief arm 162 and 164 is moveable with respect to a respective second strain relief arm 180 and 182 by sliding the pins 172 within the slots 192. That allows adjustment of the strain relief structure 106 by moving the first strain relief arms 162 and 164 into and out of engagement with the backshell housing 104.

A biasing member 200 is supported in the slot 192 of each of the second strain relief arms 180 and 182. The biasing member 200 is preferably a rubber spring, but may be any known biasing mechanism, such as a compression spring.

Figure 5:
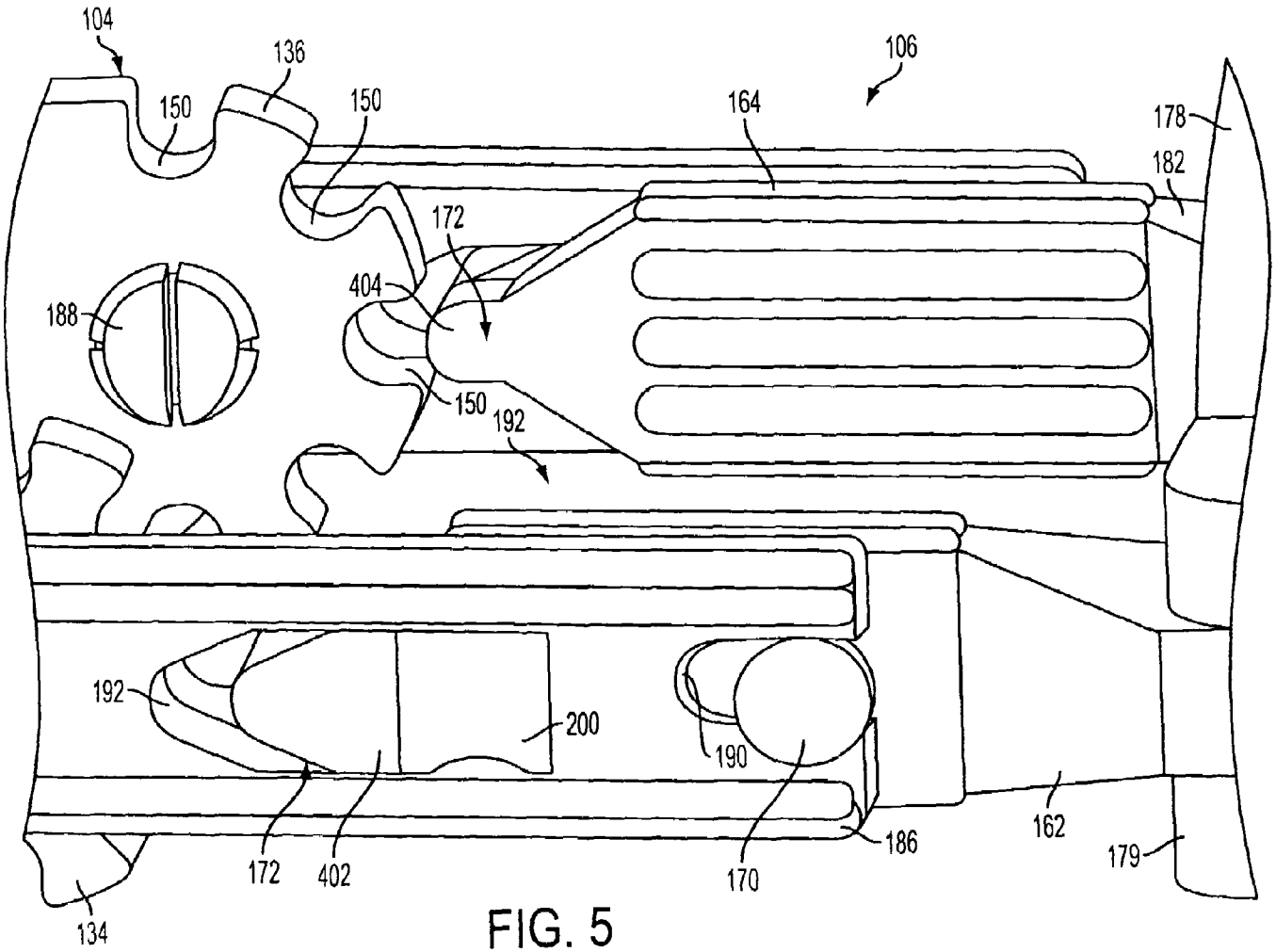
FIG. 5 is an enlarged partial side perspective view of the backshell assembly illustrated in FIG. 2, showing the strain relief structure disengaged from the housing.

Referring to FIGS. 4 and 5, the first strain relief arms 162 and 164 being engaged with and disengaged with the extensions 134 and 136 of the backshell housing 104, respectively, is shown. The first strain relief arms 162 and 164 are slidably coupled to the second strain relief arms 180 and 182 such that the first strain relief arms 162 and 164 are located inside of a respective second strain relief arm 180 and 182. In FIG. 4, the biasing members 200 bias the first strain relief arms 162 and 164 into engagement with the extensions 134 and 136 of the backshell housing 104. Specifically, a portion 402 of each location pin 172 of the first strain relief arms 162 and 164 is received in respective slots 192 of the second strain relief arms 180 and 182 with the biasing member 200 located between the portion 402 and the end of the slot 192. The other portion 404 of the location pin 172 is received in one of the notches 150 of the backshell housing extensions 134 and 136. Each notch 150 represents a different position of the strain relief structure 106 and the cable C with respect to the backshell housing 104.

Disengaging the pins 172 of the first strain relief arms 162 and 164 from the notches 150 of the housing extensions 134 and 136 allows adjustment of the cable C to different positions, as illustrated in FIGS. 3A-3C. As seen in FIG. 5, the pins 172 are disengaged from the notches 150 by sliding the first strain relief arms 162 and 164 toward the cable clamps 178 and 179 and compressing the biasing members 200. Locating pins 170 of the first strain relief arms 162 and 164 also slide with respect to the cut-outs 190 of the second strain relief arms 180 and 182. The separation of the position pins 172 from the notches 150, allows the second strain relief arms 180 and 182 to pivot about pivot pins 172 with respect to the housing extensions 134 and 136 to a desired position for the cable C. Then by releasing the first strain relief arms 162 and 164, the biasing members 200 force the position pins 172 into the desired notches 150.

FIGS. 3A-3C illustrate exemplary positions in which the cable C may be configured with respect to the backshell housing 104 using the adjustable strain relief structure. FIG. 3A shows the cable C in a 0° configuration. That is the angle $\alpha$ between the central longitudinal axis 138 of the backshell housing and an axis 300 of the strain relief structure 106 and the cable C is 0°. FIG. 3B shows the cable C in a 45° configuration with the angle $\alpha$ between the central longitudinal axis 138 and the axis 300 being 45°. FIG. 3C shows the cable C in a 90° configuration with the angle $\alpha$ between the central longitudinal axis 138 and the axis 300 being 90°. The cable C may be adjusted to any configuration based on position notches 150 of the housing extensions 134 and 136. Any number of position notches 150 may be used, although at least 2 position notches 150 is preferred.

Referring to FIG. 6, a cross-sectional view of the coupling nut 102 coupled with an electrical connector 600 and the backshell housing 104. The ring of gear teeth 142 are received in a recessed portion 602 in the inner surface 604 of the coupling nut 102. The retaining ring 148 is located between the gear teeth 142 to retain the housing 104 in the coupling nut 102. The accessory locating ring 144 is located inside of the backshell housing 104 at its connector interface 132. For clarity, only the shielding braid S (and not cable C) is shown in FIG. 6. A terminal end 608 of the shielding braid S wraps around the connector interface 132 of the backshell housing 104. That allows direct contact with the connector shell 610 of the electrical connector 600 and the braid S. Specifically, the terminal end 608 of the shielding braid S is sandwiched between an inner surface 612 of the housing connector interface 132 and an outer surface 614 of the connector shell 610 when the electrical connector 600 is mated with the backshell assembly 100. No additional components are needed between the braid's terminal end 608 and the connector shell to providing EMI protection. That ensures better EMI protection due to the elimination of intermediate electrical interfaces.

As seen in FIG. 6, steel rivets 606 are located in the coupling nut 102 and the termination ring 146 is disposed around the housing interface 132 and the shielding braid.

While a particular embodiment has been chosen to illustrate the invention, it will be understood by those skilled in the art that various changes and modifications can be made therein without departing from the scope of the invention as defined in the appended claims.

What is claimed is:

1. A backshell assembly, comprising of:

a housing configured to terminate a cable, said housing having a main body defining a central longitudinal axis, a connector interface for mating with an electrical connector, and at least one adjustment extension extending from said main body opposite said connector interface and substantially parallel to said central longitudinal axis; and an adjustable strain relief structure coupleable to the cable and said housing, including:

at least one adjustment member coupleable to the cable, said adjustment member cooperating with said adjustment extension of said housing such that said adjustment member is moveable between different cable positions with respect to said central longitudinal axis of said housing; and a biasing member disposed between said at least one adjustment member and said at least one adjustment extension of said main body, said biasing member biasing said at least one adjustment member into engagement with said at least one adjustment extension, wherein said biasing member allows adjustment of said at least one adjustment member between said different cable positions with respect to said at least one adjustment extension of said housing without disassembly of said housing and said adjustable strain relief structure.

2. A backshell assembly according to claim 1, wherein said biasing member is a spring.

3. A backshell assembly according to claim 1, wherein said adjustment member being moveable out of engagement with said adjustment extension of said housing by moving said adjustment member against the bias of said biasing member.

4. A backshell assembly according to claim 1, further comprising:

at least one cable clamp coupled to an end of said adjustment member for clamping the cable.

5. A backshell assembly according to claim 1, wherein the cable includes a shielding braid sock, a terminal end of said shielding braid being adapted to directly contact an electrical connector.

6. A backshell assembly according to claim 1, wherein said housing includes a plurality of adjustment extensions; and said adjustment member includes a plurality of strain relief arms corresponding to said plurality of adjustment extensions.

7. A backshell assembly for mating with an electrical connector according to claim 1, wherein no components are located between the connector shell and said terminal end of said shielding braid.

8. A backshell assembly for mating with an electrical connector according to claim 1, wherein said terminal end of said shielding braid is sandwiched between said connector interface and said connector shell.

9. A backshell assembly according to claim 1, wherein said adjustment member defining an axis, and said different cable positions of said adjustment member with respect to said central longitudinal axis of said housing being defined by an angle between said axis of said adjustment member and said central longitudinal axis of said housing.

10. A backshell assembly according to claim 9, wherein said different cable positions including 0, 45 and 90 degree angles between said axis of said adjustment member and said central longitudinal axis of said housing.

11. A backshell assembly according to claim 1, wherein an end of said at least one adjustment extension of said housing including a plurality of cable position notches configured to releasably receive said adjustment member, said plurality of notches corresponding to said different cable positions.

12. A backshell assembly according to claim 11, wherein said adjustment arm includes a pin extension at a distal end thereof that releasably engages one of said plurality of notches of said housing.

13. A backshell assembly according to claim 1, wherein said adjustment member of said adjustable strain relief structure being a first arm;

and said adjustable stain relief structure including a second arm coupled to said first arm, said second arm supporting said biasing member and being coupled to said at least one adjustment extension.

14. A backshell assembly according to claim 13, wherein said second arm including a pivot pin coupled to a pivot hole of said adjustment extension of said housing allowing said second arm to pivot with respect to said adjustment extension.

15. A backshell assembly according to claim 13, wherein said first arm including a pin extension at a distal end thereof received in a slot of said second arm, said first arm being slidably moveable in said slot to move said pin extension into and out of engagement with said adjustment extension of said housing.

16. A backshell assembly according to claim 15, wherein said pin extension abutting said biasing member supported by said second arm, said first arm being moveable out of engagement with said adjustment extension of said housing by moving said pin extension of said first arm against the bias of said biasing member.

17. A method of adjusting a backshell assembly for a cable, the backshell assembly including a housing and an adjustable strain relief structure, comprising the steps of:

terminating an end of the cable with the housing of the backshell assembly;

coupling the adjustable strain relief structure with the housing by releasably engaging a first arm of the strain relief structure with the housing to configure the cable in at least a first position with respect to the housing, and pivotally connecting a second arm of the strain relief structure with the housing allowing rotation of the adjustable strain relief structure and the cable with respect to the housing;

disengaging the first arm from the housing by slidably moving the first arm of the strain relief structure with respect to the second arm against the bias of a biasing member supported by the second arm; and releasably locking the first arm in a second position different from the first position by releasing the first arm of the strain relief structure so that the first arm slides with respect to the second arm into engagement with the housing.

18. A method according to claim 17, further comprising the step of:

clamping the adjustable strain relief structure on the cable.

19. A method according to claim 17, further comprising the step of:

interfacing the housing with a mating electrical connector using a coupling nut.

* * * * *